US006045454A

United States Patent [19]

Chu

[11] Patent Number: 6,045,454

[45] Date of Patent: Apr. 4, 2000

[54] PRACTICE GOLF BALL

[76] Inventor: Li-Tsan Chu, 2 Floor, No. 15, Lane 81, Kwuang-Fu S. Rd., Taipei, Taiwan

[21] Appl. No.: 09/347,306

[22] Filed: Jul. 6, 1999

[51] Int. Cl.[7] ..... A63B 69/36; A63B 37/00

[52] U.S. Cl. ..... 473/280; 473/368

[58] Field of Search ..... 473/280, 351, 473/367, 368

[56] References Cited

U.S. PATENT DOCUMENTS

| | | | |
|---|---|---|---|
| 2,342,603 | 2/1944 | Ryan | 473/368 X |
| 2,343,160 | 2/1944 | Smith | 473/356 X |
| 3,288,469 | 11/1966 | Shaw | 473/280 |
| 4,886,275 | 12/1989 | Walker | 473/280 |
| 4,995,613 | 2/1991 | Walker | 473/280 |
| 5,630,763 | 5/1997 | Li-Tsan | 473/280 X |

*Primary Examiner*—John A. Ricci

[57] ABSTRACT

A practice golf ball is produced by sewing up at least two pieces of preferably symmetrical surface cloth to form a ball shell defining a spherical space therein and evenly stuffing fibrous material into the spherical inner space via an opening left on a seam between the sewed-up surface cloths. The opening is then sewed up to seal the fibrous material in the ball shell. A thermosetting resin is injected into a geometrical center of the ball shell. When the resin is cooled and set, it binds the fibrous material at the geometrical center and forms a weighted core that provides a stable center of gravity for the completed practice golf ball.

1 Claim, 5 Drawing Sheets

PRACTICE GOLF BALL

BACKGROUND OF THE INVENTION

The present invention relates to a practice golf ball, and more particularly to a practice golf ball that has high sphericity and a center of gravity consistent with a geometrical center of the ball.

In consideration of the safety of practicing golf indoors, a practice golf ball is usually employed for such purpose. The currently available practice golf balls can be generally divided into two types according to their material, namely, plastic and fibrous material practice golf balls.

FIG. 1 illustrates a conventional practice golf ball made of plastic material. A part of the golf ball is shown in sectional view in order to better show the structure thereof. The illustrated conventional practical golf ball is formed by plastic material through injection molding and is a hollow ball having a spherical shell. A plurality of through holes are provided on the spherical shell. An advantage of such plastic practice golf ball is its low manufacture cost. However, the plastic practice ball tends to deform when being struck with a club and will therefore have a center of gravity deviated from a geometrical center of the ball. This condition would cause the plastic practice ball to fly in the air along a path that deviates from a path along which a real golf ball would usually fly. In other words, practicing golf with the plastic practice golf ball does not ensure a good performance and an observed path of the flying plastic practice golf ball does not ensure a real correct path has been controlled by the golf player.

To improve the plastic practice golf ball, another type of practice golf ball made of fibrous material has been developed. U.S. Pat. No. 5,630,763 entitled "Golf Training Ball" granted to Chu Li-Tsan, also the inventor of the present invention, discloses a golf training ball made of soft fibrous material that is compressed into two semispherical halves that are then separately wrapped with a woven material. The woven material usually includes two pieces of circular fabric having the same extended area. When using the circular fabric to wrap each semispherical half of compressed fibrous material, a circumferential outer periphery of the circular fabric is gathered to locate at a center of a flat surface of the semispherical half and sewed up. The two semispherical halves wrapped with the woven fabric are then connected to one another at their flat surfaces to form a complete ball and the seam between them is sewed up with a string. Such golf training ball made of compressed fibrous material has somewhat stable center of gravity compared to the plastic practice golf ball. A disadvantage of the golf training ball disclosed in U.S. Pat. No. 5,630,763 is that the woven fabric wrapping the compressed fibrous material does not provide a smoothly curved edge along the outer periphery of the flat surface of the semispherical half. Moreover, the two semispherical halves of the compressed fibrous material are not always identical in dimensions and the circumferential outer periphery of the round fabric is not always gathered to just locate at the center of the flat surface of the semispherical half. That is, the golf training ball formed from the sewed-up two halves does not always have high sphericity and/or evenly distributed fibrous material. More specifically, the center of gravity of such fibrous golf training ball frequently deviates from the geometrical center of the ball to possibly cause a deviated fly path as would find in the case of a plastic practice golf ball.

It is therefore desired by the inventor to develop an improved practice golf ball to eliminate the drawbacks existing in the conventional practice golf balls made of plastic material or fibrous material.

SUMMARY OF THE INVENTION

A primary object of the present invention is to provide a practice golf ball that has high sphericity and a non-deviated center of gravity located at a geometrical center of the ball, so that the practice golf ball struck out with a club can always stably fly in the air along a path that is generally consistent with a path along which a real golf ball would fly. And therefore, any effect of practice can be correctly observed from the flying practice golf ball.

To achieve the above and other objects, the practice golf ball provided by the present invention mainly includes at least two pieces of preferably symmetrical surface cloth that are sewed up to form a ball shell defining a spherical space therein. A suitable type of fibrous material is evenly stuffed into the spherical inner space via an opening left on a seam between the sewed-up surface cloths. The opening is then sewed up to seal the fibrous material in the ball shell. A thermosetting resin is injected into a geometrical center of the ball shell. When the resin is cooled and set, it binds the fibrous material at the geometrical center and forms a weighted and solid core that provides a stable center of gravity for the completed practice golf ball to always consistent with the geometrical center of the ball.

BRIEF DESCRIPTION OF THE DRAWINGS

The structural features of the present invention can be best understood by referring to the following detailed description of the preferred embodiments and the accompanying drawings, wherein.

DETAILED DESCRIPTION OF THE PREFERRED EMBODIMENTS

Figure 1:
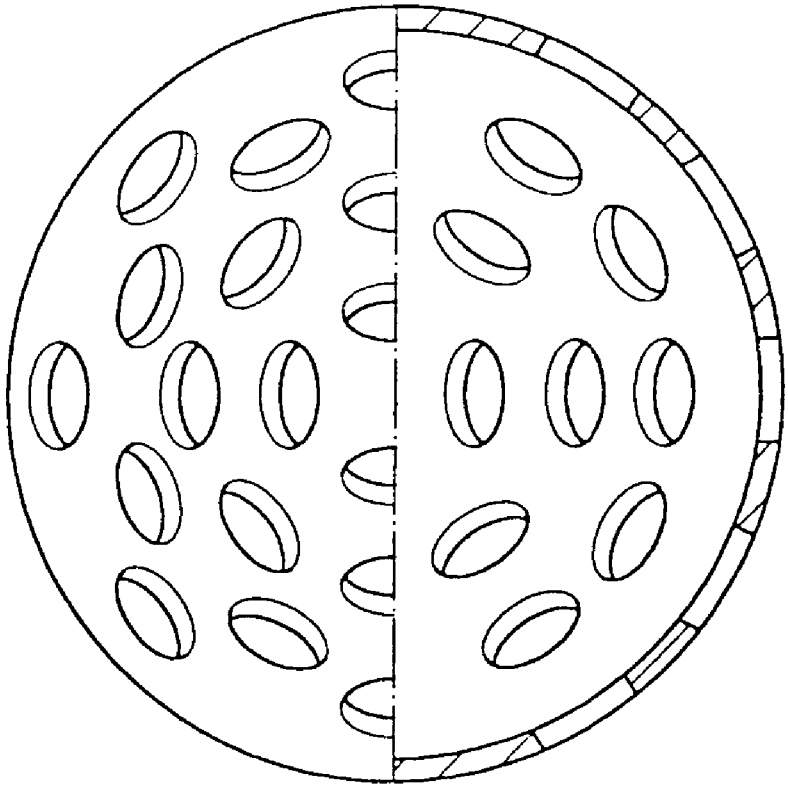
(PRIOR ART) Fig.1
FIG. 1 is a partially sectional plan view of a conventional plastic practice golf ball.
Figure 2:
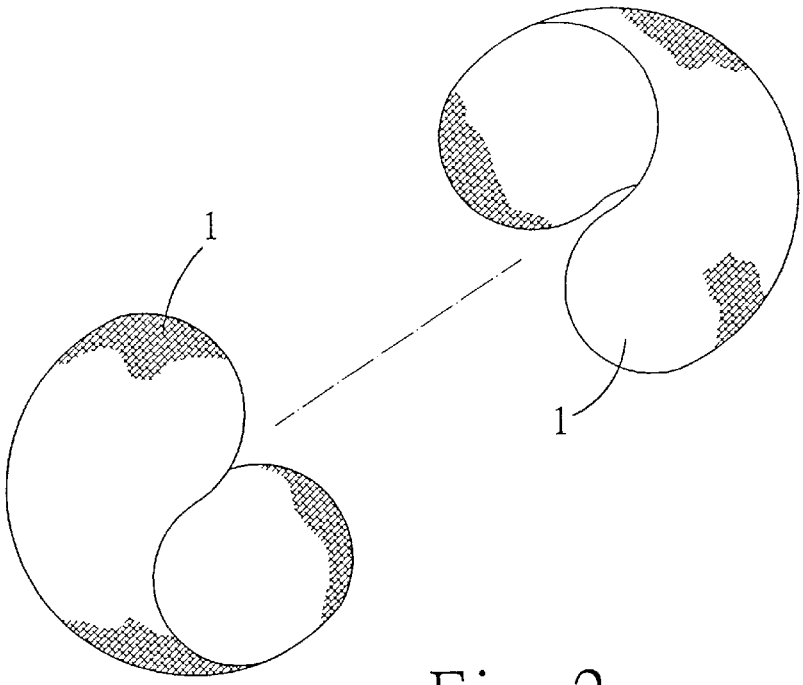
FIG. 2 shows two pieces of surface cloth for forming a shell of a complete practice golf ball according to the present invention.
Figure 3:
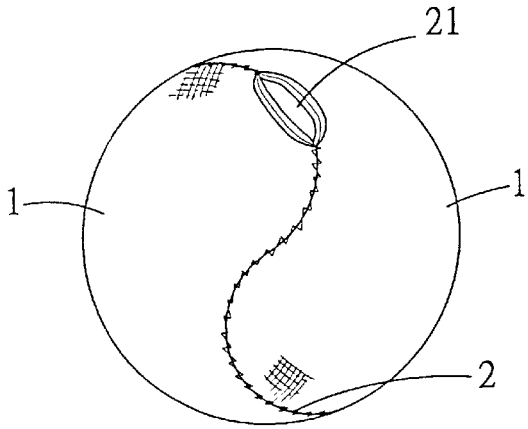
FIG. 3 shows the manner of sewing up the two pieces of surface cloth of FIG. 2 with an opening left therebetween.

Please refer to FIGS. 2 and 3. The practice golf ball according to the present invention is formed mainly by sewing up at least two separated pieces of preferably symmetrical surface cloth 1. The surface cloths 1 are first engaged with one another to provide a ball-shaped shell that defines a spherical inner space. Thereafter, the surface cloths 1 are sewed up along a curved seam between them by using a suitable type of string 2. A small section of the seam in proper length is left open to form an opening 21.

Figure 4:
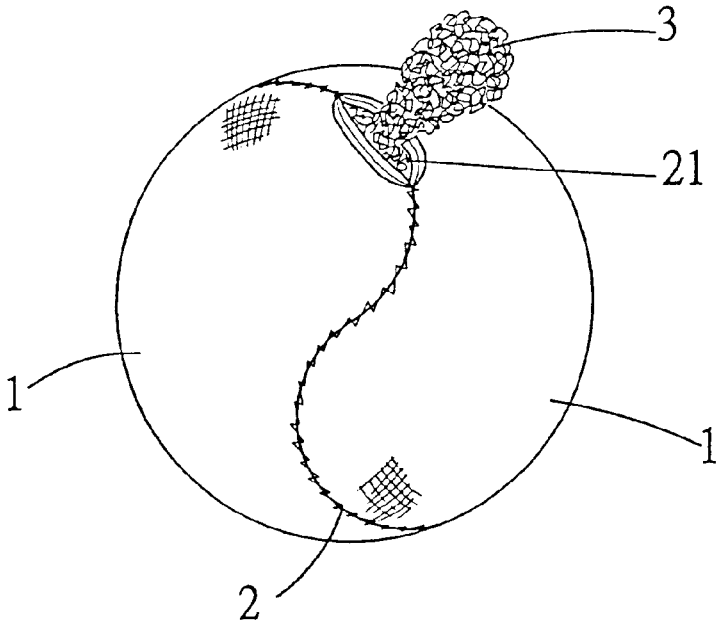
FIG. 4 shows the manner of stuffing fibrous material into the sewed-up surface cloth via the preformed opening.
Figure 5:
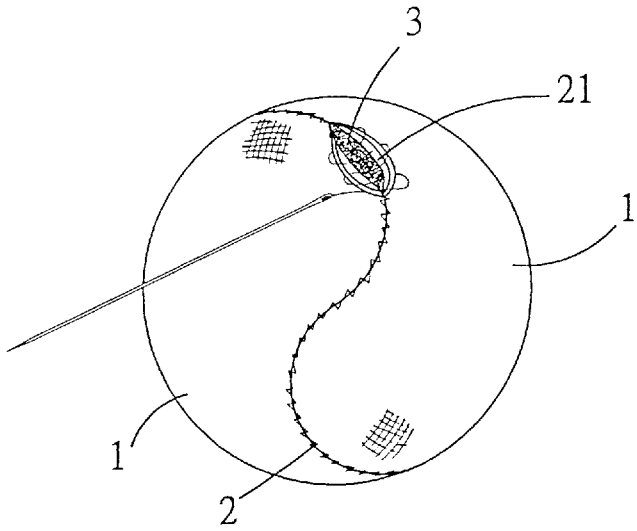
FIG. 5 shows the manner of sewing up the opening on the practice golf ball.
Figure 6:
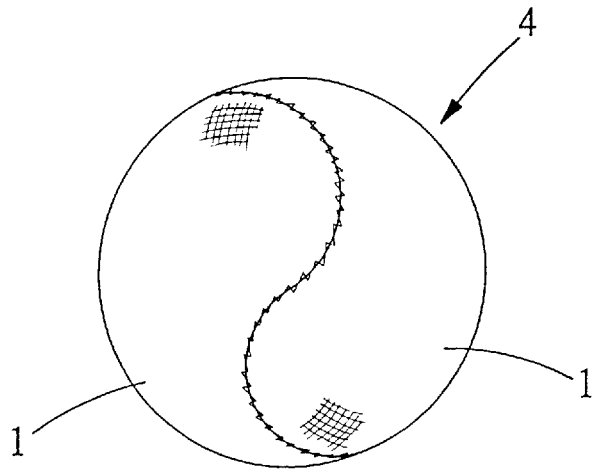
FIG. 6 shows a complete practice golf ball after the opening has been sewed up.

As shown in FIG. 4, an adequate amount of a suitable type of fibrous material 3 is stuffed via the opening 21 into the spherical inner space in the ball-shaped shell formed from the sewed-up surface cloths 1. When the ball-shaped shell is fully stuffed with the fibrous material 3, the opening 21 is sewed up with the string 2 to form a substantially solid ball 4, as shown in FIGS. 5 and 6.

Figure 7:
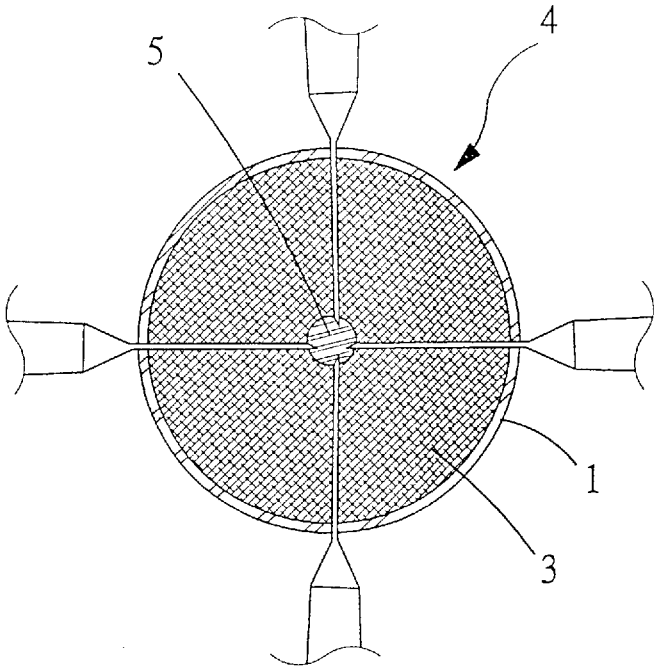
FIG. 7 shows the manner of injecting thermosetting resin into a center of the practice golf ball.
Figure 8:
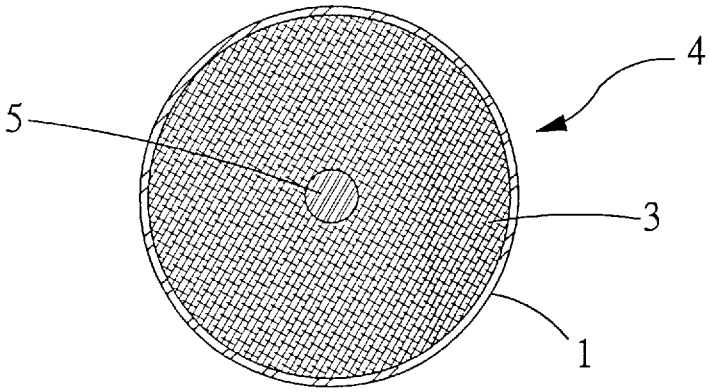
FIG. 8 is a sectional view of the completed practice golf ball according to the present invention.

To give the solid ball 4 a stable center of gravity that is always consistent with a geometrical center of the ball 4, a suitable type of thermosetting resin 5 is injected into the geometrical center of the solid ball 4. As shown in FIG. 7, four pieces of suitable injecting device are used to pierce through the fibrous material 3 stuffed in the ball 4 at the same time until their respective pointed head reaches the geometrical center of the ball 4. Then, the thermosetting resin 5 previously loaded in the four injecting devices is injected into the ball 4 to bind the fibrous material 3 at the geometrical center of the ball 4 together. After the thermosetting material 5 is cooled and set, it together with the fibrous material 3 bound at the center of the ball 4 form an integral solid core with suitable weight that forms a stable center of gravity of the ball 4 just located at the geometrical center of the ball 4.

Following are some features of the practice golf ball of the present invention:

A. The practice golf ball has a suitably weighted core fixed at its geometrical center that therefore forms a stable center of gravity of the ball 4, too. Therefore, the practical golf ball of the present invention can fly in the air along a true and stable path that allows good and correct observation of a real effect from practices.

B. The fibrous material 3 is stuffed after the ball-shaped shell is formed from the two sewed-up surface cloths 1 and can therefore be evenly distributed in the spherical inner space to provide a ball 4 with high sphericity.

C. The thermosetting resin 5 is injected into the geometrical center of the ball 4 to bind the fibrous material 3 thereat into an integral core without easily deviating from the geometrical center of the ball 4. Therefore, the ball 4 has a stable center of gravity to allow the ball to fly stably.

D. The ball 4 is formed in a manner much easier than that for forming the conventional practice golf balls.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A practice golf ball comprising at least two pieces of preferably symmetrical surface cloth that are sewed up with a suitable type of string along seams between said pieces of surface cloth to define a spherical inner space, an adequate amount of a suitable type of fibrous material that is stuffed into said spherical inner space defined by said sewed-up pieces of surface cloth via an opening of suitable size left on said seams and said opening being sewed up with said string after said fibrous material has been evenly distributed in said spherical inner space, and a suitably weighted core formed by injecting adequate amount of a suitable type of thermosetting material into a geometrical center of said spherical inner space to bind a part of said fibrous material located at said geometrical center when said thermosetting material becomes cooled and set; whereby said weighted core forms a center of gravity of said practice golf ball always consistent with said geometrical center of said practice golf ball to allow the same to fly stably when being struck out with a club.

* * * * *